US010565829B1

(12) United States Patent
Georgilas et al.

(10) Patent No.: US 10,565,829 B1
(45) Date of Patent: Feb. 18, 2020

(54) SKILL-BASED BINGO GAMING SYSTEM AND METHOD OF USING THE SAME

(71) Applicant: First Gaming Group, LLC, Las Vegas, NV (US)

(72) Inventors: Justin Tilemahos Georgilas, Las Vegas, NV (US); Evgeny Bronnikov, Novosibirsk (RU)

(73) Assignee: First Gaming Group, LLC, Las Vegas, NV (US)

( * ) Notice: Subject to any disclaimer, the term of this patent is extended or adjusted under 35 U.S.C. 154(b) by 35 days.

(21) Appl. No.: 15/635,108

(22) Filed: Jun. 27, 2017

Related U.S. Application Data

(60) Provisional application No. 62/355,135, filed on Jun. 27, 2016.

(51) Int. Cl.
*A63F 9/24* (2006.01)
*G07F 17/32* (2006.01)

(52) U.S. Cl.
CPC ..... *G07F 17/3295* (2013.01); *G07F 17/3213* (2013.01)

(58) Field of Classification Search
CPC ..... A63F 9/24; A63F 3/062
See application file for complete search history.

(56) References Cited

U.S. PATENT DOCUMENTS

2003/0064772 A1* 4/2003 Tempest ..... G07F 17/32 463/16
2005/0026664 A1* 2/2005 Bansemer ..... A63F 9/0291 463/7
2007/0155471 A1* 7/2007 Powell ..... G07F 17/3286 463/19
2012/0184346 A1* 7/2012 Kepler ..... G07F 17/3262 463/19
2014/0357366 A1* 12/2014 Koganezawa ..... G06T 19/006 463/31

* cited by examiner

*Primary Examiner* — Lawrence S Galka
(74) *Attorney, Agent, or Firm* — FisherBroyles, LLP; Rob L. Phillips

(57) ABSTRACT

A gaming device and method for conducting an electronic bingo game incorporating a skill-based exercise whereby a player may purchase additional bingo ball draws. Players may use skill to attempt to select specific bingo balls to ensure one or more winning outcomes. The skill-based exercise requires the player to open a trap door over which the remaining bingo balls roll along a conveyor belt. Other skill-based exercises may be implemented to permit a player to attempt to select specific bingo balls.

16 Claims, 6 Drawing Sheets

SKILL-BASED BINGO GAMING SYSTEM AND METHOD OF USING THE SAME

CROSS-REFERENCE

This application claims priority to U.S. Patent Application No. 62/355,135 filed Jun. 27, 2016 which is incorporated herein for all purposes.

FIELD OF THE INVENTION

The embodiments of the present invention relate to a gaming system for conducting a casino bingo game with a skill-based component for selecting specific bingo balls.

BACKGROUND

Gaming continues to grow throughout the United States. The primary area of growth in recent years relates to slot machines and related electronic casino games, including skill-based games. Skill-based games have been approved by numerous states, including Nevada.

Moreover, conventional slot machines and other electronic gaming devices can become stale after being on the casino floor for long periods of time. Skill-based games are also attractive to younger players (Millennials).

Thus, it would be advantageous to develop new skill-based casino games, including bingo games which are very popular.

SUMMARY

The embodiments of the present invention are directed to a gaming machine and method for conducting an electronic bingo game incorporating a skill-based component. Traditional video bingo games comprise a player purchasing one or more virtual bingo cards after which a pre-established number of random bingo balls are drawn to determine if any of the player's virtual bingo cards generate a winning outcome. If not, many video bingo games, allow the player to purchase additional bingo ball draws to further the player's chance of generating one or more winning bingo outcomes.

With the embodiments of the present invention, the player may purchase additional bingo ball draws. In this instance, players may use certain skills to attempt to select specific bingo balls to generate one or more winning outcomes. In one embodiment, the skill-based component requires the player to open a trap door over which the remaining bingo balls roll along a conveyor belt. Other skill-based exercises may be implemented to permit a player to attempt to select specific bingo balls (e.g., catching bingo balls in a basket, shooting bingo balls from cannons, highlighting bingo balls which the player attempts to press stop on desired bingo ball, etc.

Other variations, embodiments and features of the present invention will become evident from the following detailed description, drawings and claims.

DETAILED DESCRIPTION

Figure 1:
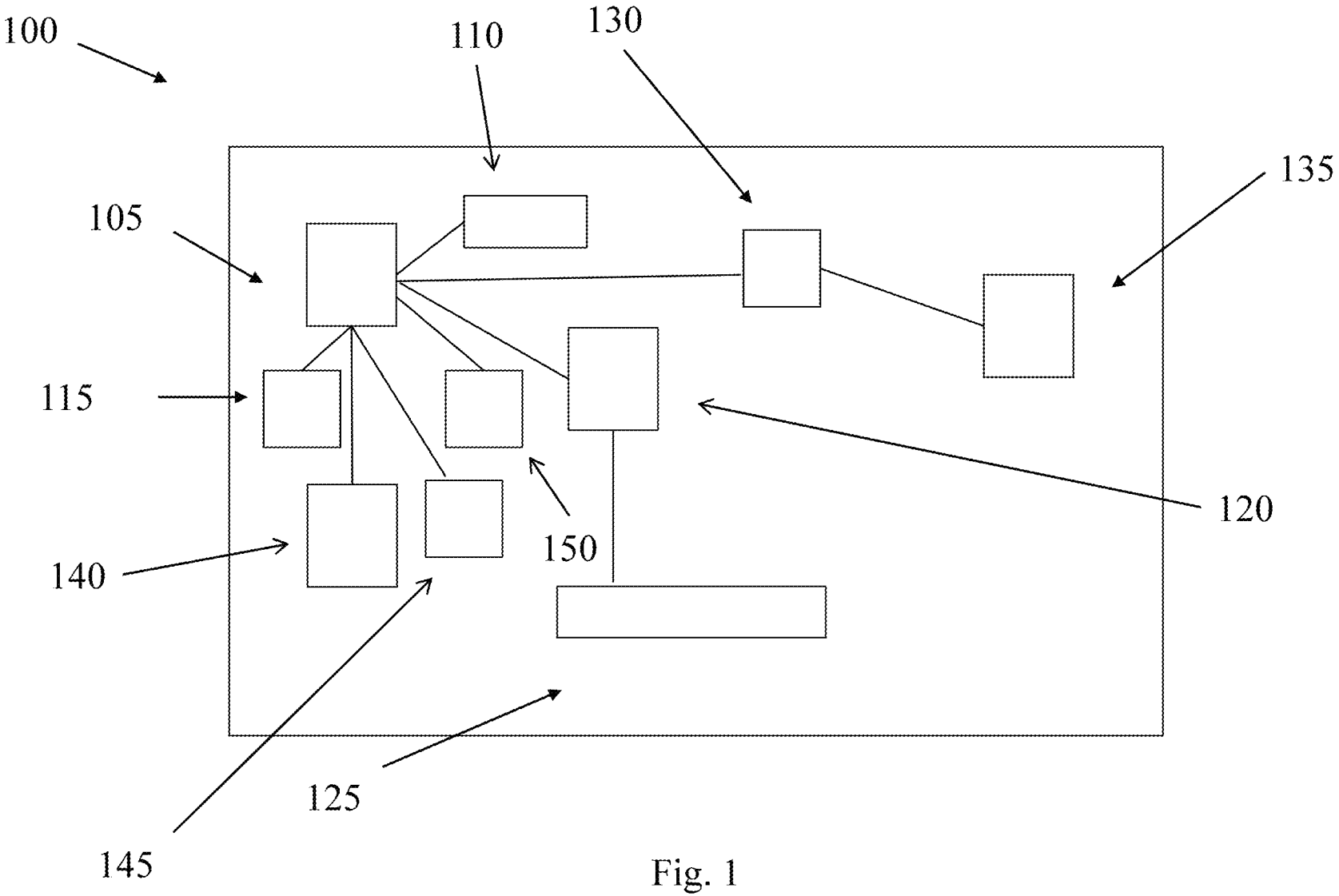
FIG. 1 illustrates a block diagram of components of an electronic gaming device for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming device whereby a single player plays against the electronic gaming device's processor as described herein. The electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
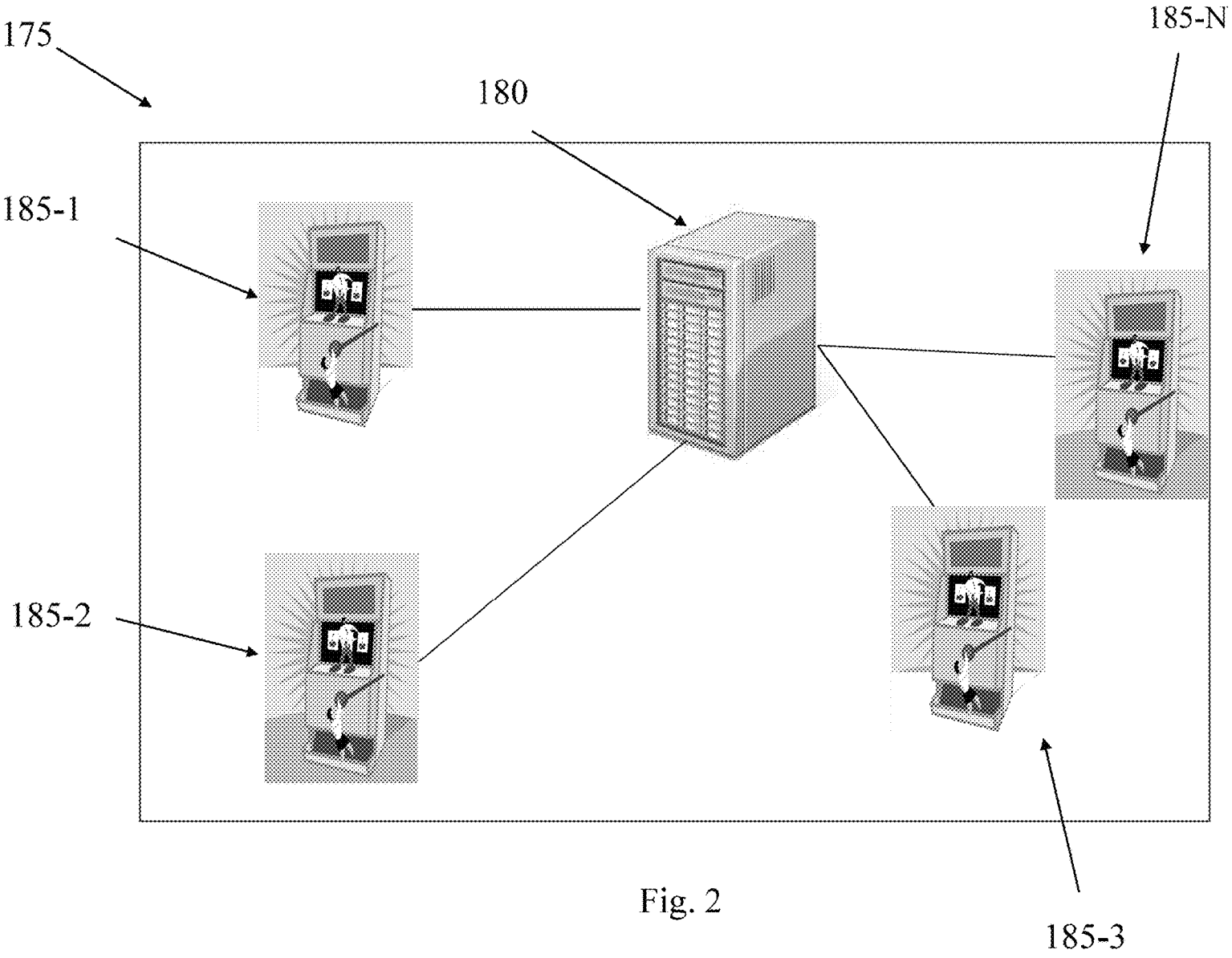
FIG. 2 illustrates a block diagram of a wireless network system including numerous slot machines according to the embodiments of the present invention.

FIG. 2 shows a block diagram of a gaming network 175 which may be used to facilitate play of the game via linked gaming devices according to the embodiments of the present invention. The gaming network 175 comprises a central processor 180 (e.g., processor-equipped game server) in communication with multiple gaming devices 185-1 through 185-N as described in FIG. 1.

Figure 3:
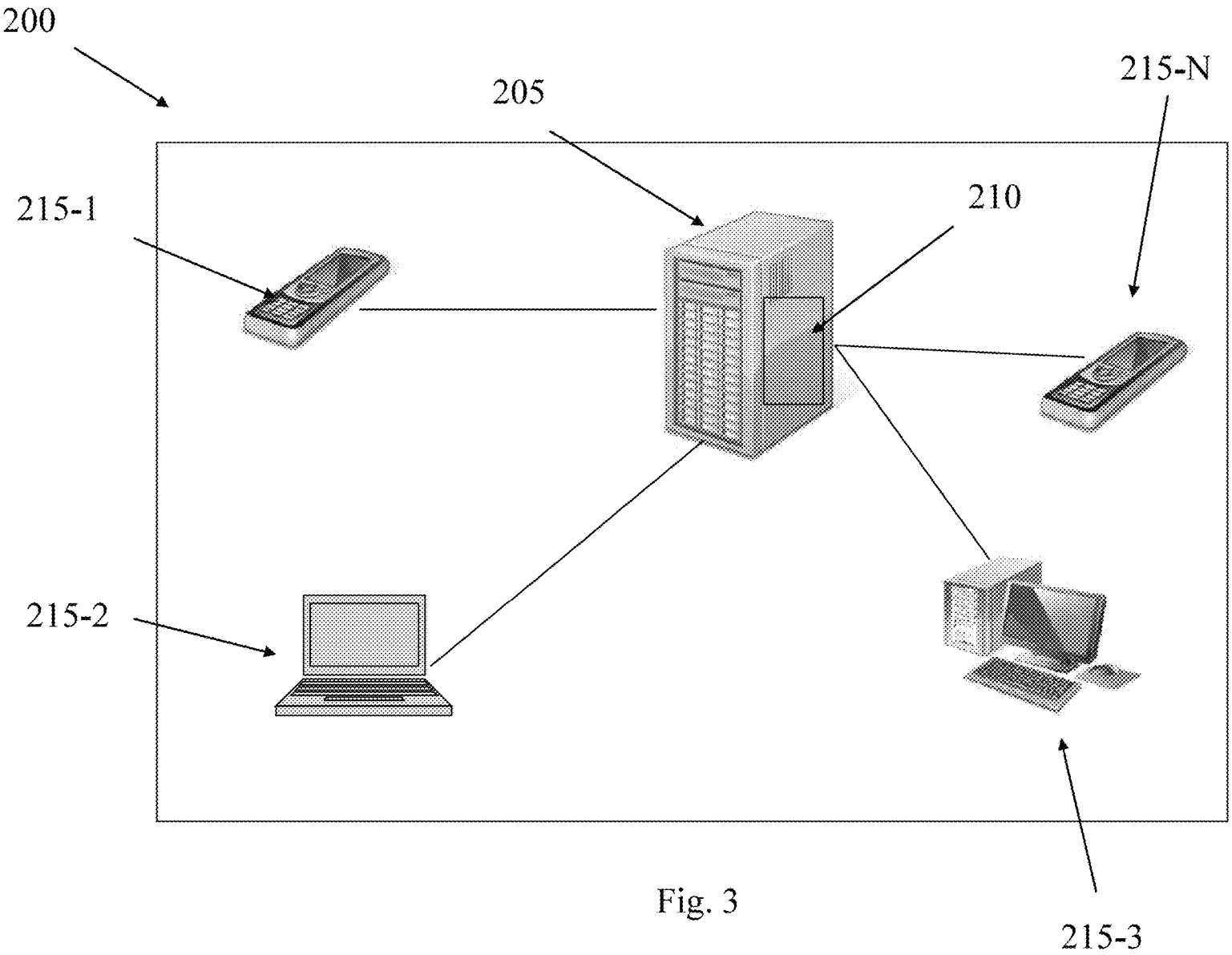
FIG. 3 illustrates a block diagram of a wireless network system accessible by mobile devices for conducting mobile games of chance according to the embodiments of the present invention.

FIG. 3 shows a block diagram of a wireless system 200 which may be used to facilitate remote play of the game according to the embodiments of the present invention. The wireless network system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith.

Figure 4A:
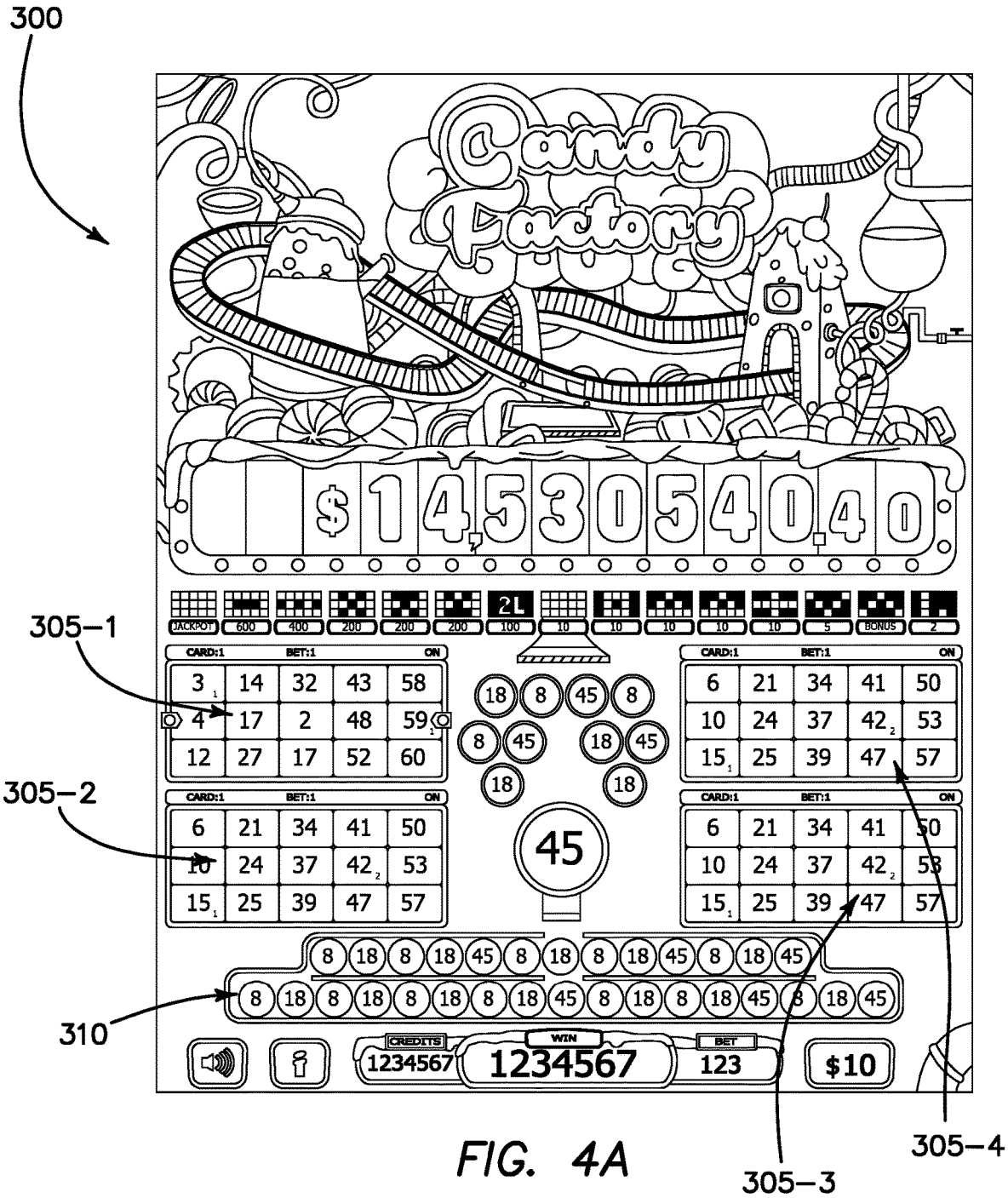
FIGS. 4A and 4B illustrate screen shots of a skill-based bingo gaming machine according to the embodiments of the present invention.

FIG. 4A illustrates a screen shot 300 of a primary game according to the embodiments of the present invention. As shown, the primary game is a video bingo game. As shown, four virtual bingo cards 305-1 through 305-4 are depicted. A history of drawn bingo balls 310 is maintained on the display.

Figure 4B:
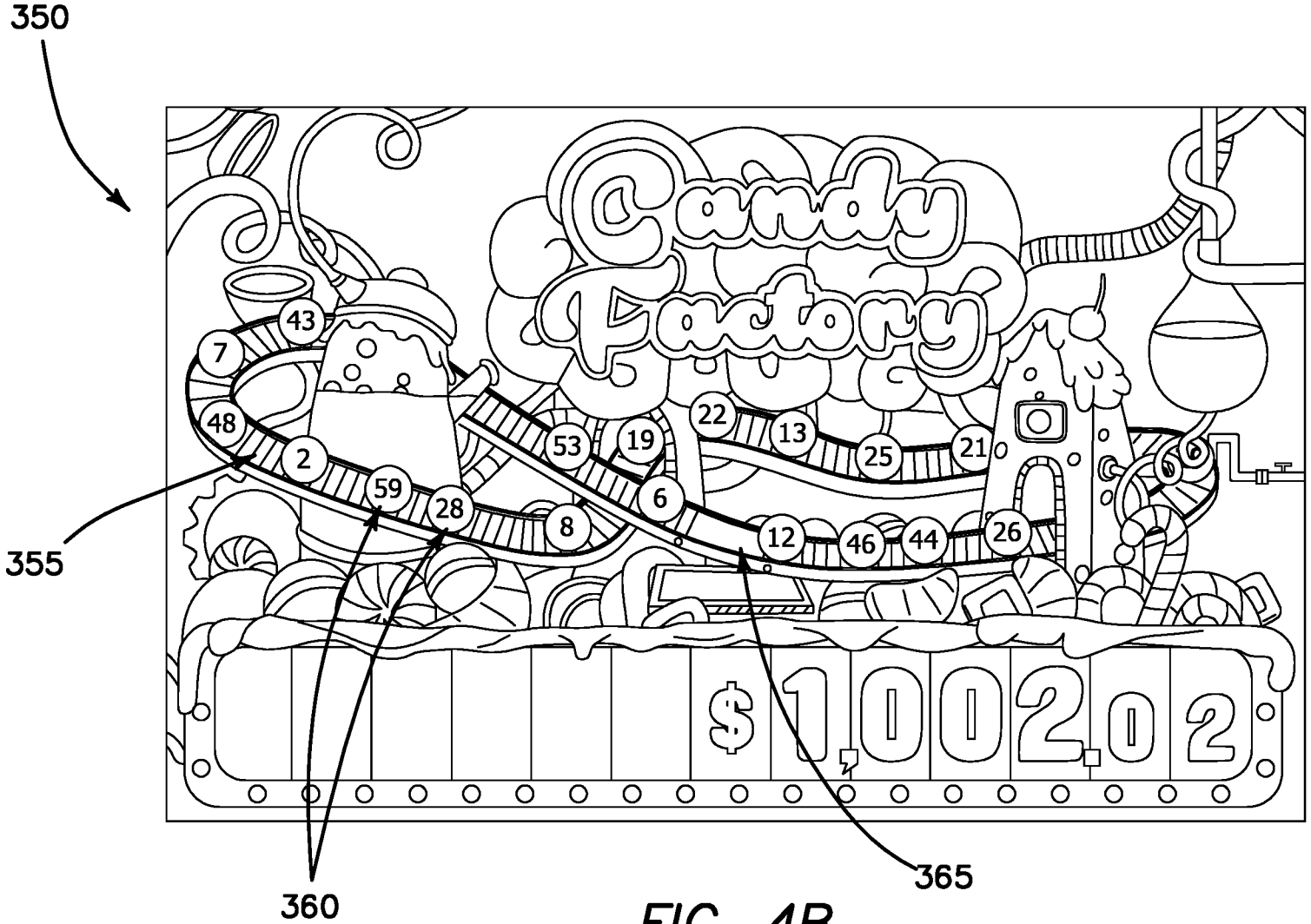

FIG. 4B illustrates a screen shot 350 depicting a skill-based exercise associated with the bingo game detailed herein. The skill-based exercise comprises a conveyor belt 355 over which remaining (i.e., non-drawn) bingo balls 360 traverse. As the bingo balls 360 traverse the conveyor belt 355, a player is permitted to momentarily activate a trap door 365 to allow one of the bingo balls 360 to fall off the path 355 affording the player to opportunity to skillfully attempt to select desirable bingo balls. The pace at which the bingo balls 360 move along the conveyor belt 355 may be increased or decreased to alter the skill level required. The skill level may be further altered by having the bingo balls 360 spin such that the bingo number is temporarily concealed. For example, the closer the player is to achieving a bingo, the faster the bingo balls may move and/or spin. Depending on the embodiment, activation of the trap door 365 may always cause a next bingo ball to drop or the trap door may open and close without a bingo ball dropping if timed improperly.

In other embodiments, the trap door 365 skill-based exercise is replaced with other skill-based exercises permitting the player to attempt to select specific bingo balls. For example, the player may attempt to capture one or more bingo balls using a virtual net as a plurality of bingo balls are depicting flying through the air. Any number of skill-based exercises may be utilized.

Figure 5:
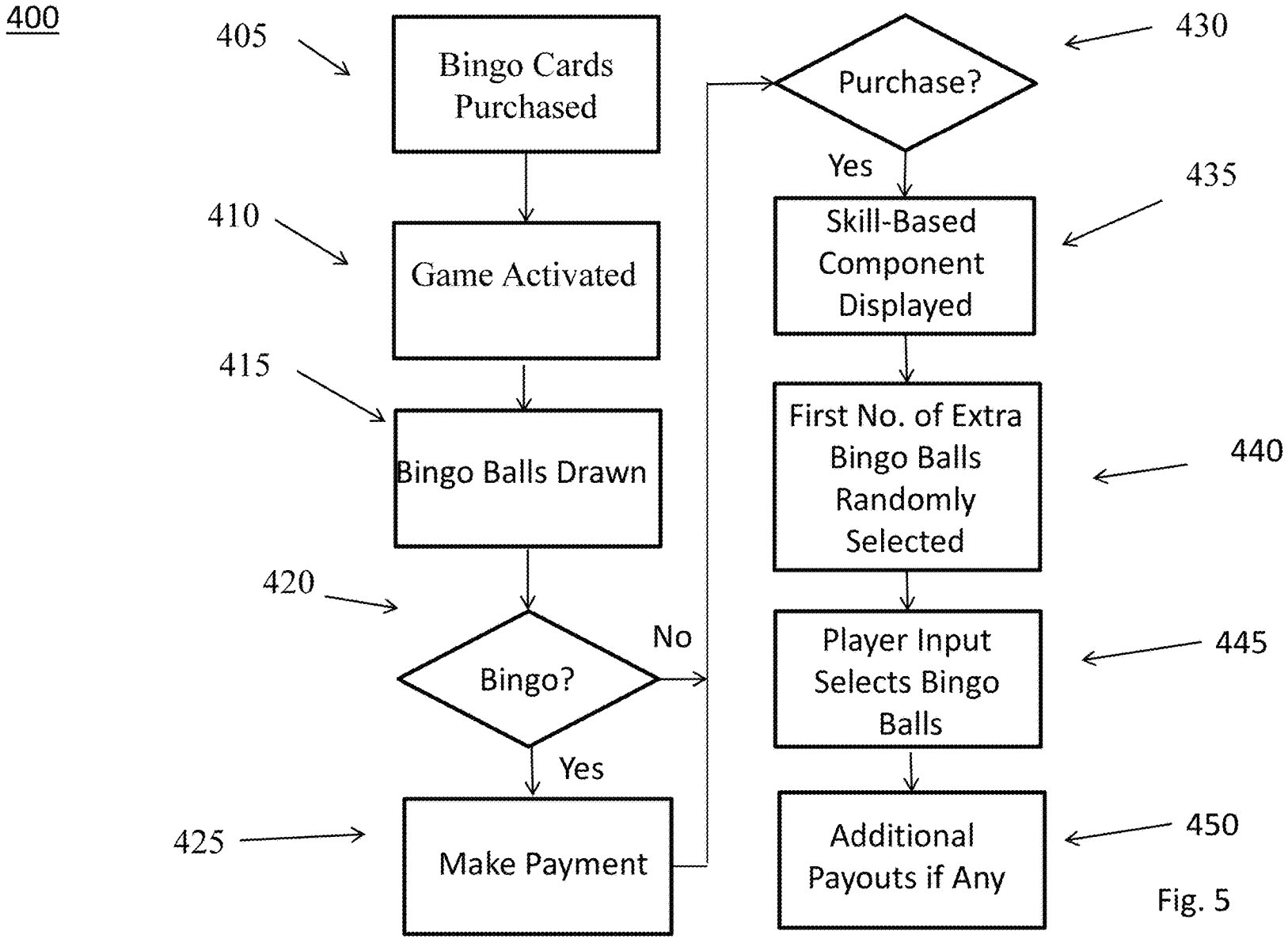
FIG. 5 illustrates a flow chart detailing one methodology for conducting a skill-based bingo game according to the embodiments of the present invention.

FIG. 5 shows a flow chart 400 detailing a method conducting a skill-based bingo game according to the embodiments of the present invention. At 405, a player purchases one or more virtual bingo cards. At 410, the player activates the game via a spin button, ball-selection button or other input device. At 415, a pre-established number (e.g., 30) of bingo balls are drawn. At 420, it is determined if any bingo cards depict a bingo/winning outcome. If so, at 425, a primary game payout is made. At 430, it is determined if the player desires to purchase additional bingo balls (e.g., 10 more). If so, at 435, the skill-based exercise is displayed. At 440, in one embodiment, a first number (e.g., 8) of the additional bingo balls are randomly drawn. At 445, the player attempts, via the skill-based exercise, to select the remaining number of additional bingo balls (e.g., $9^{th}$ and $10^{th}$). At 450, additional payouts are made for any bingo cards showing bingo based on the draw of the additional bingo balls. The payouts are typically less for a bingo using additional purchased bingo balls than a bingo achieved from the first round of drawn bingo balls.

Although the invention has been described in detail with reference to several embodiments, additional variations and modifications exist within the scope and spirit of the invention as described and defined in the following claims.

We claim:

1. A gaming device comprising:

at least one processor configured to run a virtual, video-based bingo game;

a random number generator in communication with said at least one processor;

a display for depicting the virtual, video-based bingo game;

a user interface configured to accept player instructions relative to playing said virtual, video-based bingo game;

memory in communication with said at least one processor, said memory storing data related to said virtual, video-based bingo game; and wherein said processor is configured to conduct said virtual, video-based bingo game, said processor further configured to (i) randomly select a first set of bingo balls utilizing said random number generator; (ii) after said video-based bingo game starts, present a skill-based exercise on said display wherein said skill-based exercise includes displaying one or more bingo balls not randomly selected in step (i) and (iii) responsive to a skilled-based user input via said user interface responsive to said skill-based exercise, causing a selection of one or more of said displayed bingo balls not randomly selected in step (i).

2. The gaming device of claim 1 wherein said skill-based exercise further includes dynamically displaying one or more bingo balls not randomly selected in step (i).

3. The gaming device of claim 1 wherein said processor is further configured to accept payment to present a skill-based exercise on said display.

4. The gaming device of claim 1 wherein said skill-based exercise relates to activating a trap door over which bingo balls not selected in step (i) roll over, said trap door activatable by a player via said user interface.

5. The gaming device of claim 4 wherein said bingo balls spin such that a bingo number is temporarily concealed to alter the skill level needed to select one or more specific bingo balls.

6. The gaming device of claim 4 wherein said processor is configured to decrease and increase the speed of the bingo balls rolling over the trap door to alter the skill level needed to select one or more specific bingo balls.

7. A gaming system comprising:

multiple gaming devices forming a gaming device network, each gaming device having at least a display, user interface and memory, each gaming device in communication with a processor and random number generator;

said processor running executable instructions to: conduct said virtual, video-based bingo game based on the following steps: (i) randomly select a first set of bingo balls using said random number generator; (ii) after said video-based bingo game starts, present a skill-based exercise on said display wherein said skill-based exercise includes displaying one or more bingo balls not randomly selected in step (i) and (iii) responsive to a skill-based user input via said user interface responsive to said skill-based exercise, causing a selection of one or more of said displayed bingo balls not randomly selected in step (i).

8. The gaming system of claim 7 wherein said skill-based exercise further includes dynamically displaying one or more bingo balls not randomly selected in step (i).

9. The gaming system of claim 7 wherein said processor is further running executable instructions to: accept payment to present a skill-based exercise on said display.

10. The gaming system of claim 7 wherein said skill-based exercise relates to activating a trap door over which bingo balls not selected in step (i) roll over, said trap door activatable by a player via said user interface.

11. The gaming system of claim 10 wherein said bingo balls spin such that a bingo number is temporarily concealed to alter the skill level needed to select one or more specific bingo balls.

12. The gaming system of claim 10 wherein said processor is further running executable instructions to: decrease and increase the speed of the bingo balls rolling over the trap door to alter the skill level needed to select one or more specific bingo balls.

13. A gaming device comprising:

at least one processor configured to run a virtual, video-based bingo game;

a display for depicting the virtual, video-based bingo game;

a random number generator in communication with said at least one processor;

a user interface configured to accept player instructions relative to playing said virtual, video-based bingo game;

memory in communication with said at least one processor, said memory storing data related to said virtual, video-based bingo game; and wherein said processor is configured to conduct said virtual, video-based bingo game, said processor further configured to: (i) randomly select a first set of bingo balls using said random number generator; (ii) after said video-based bingo game starts, present a skill-based exercise on said display wherein said skill-based exercise includes displaying one or more bingo balls not randomly selected in step (i) rolling over a trap door and (iii) responsive to a skill-based user input via said user interface, causing said trap door to momentarily open causing to fall therethrough one of said one or more of said displayed bingo balls not randomly selected in step (i).

14. The gaming device of claim 13 wherein said processor is further configured to accept a wager to present a skill-based exercise on said display.

15. The gaming device of claim 13 wherein said bingo balls spin such that a bingo number is temporarily concealed to alter the skill level needed to select one or more specific bingo balls.

16. The gaming device of claim 13 wherein said processor is further configured to decrease and increase the speed of the bingo balls rolling over the trap door to alter the skill level needed to select one or more specific bingo balls.

* * * * *